US006526625B2

(12) United States Patent
Becken

(10) Patent No.: US 6,526,625 B2
(45) Date of Patent: Mar. 4, 2003

(54) ENHANCED PERFORMANCE TANDEM ROLLER FOR PATIO DOORS

(75) Inventor: Donald A. Becken, Burbank, CA (US)

(73) Assignee: Truth Hardware, Owatonna, MN (US)

( * ) Notice: Subject to any disclaimer, the term of this patent is extended or adjusted under 35 U.S.C. 154(b) by 0 days.

(21) Appl. No.: 09/865,212

(22) Filed: May 24, 2001

(65) Prior Publication Data

US 2001/0054258 A1 Dec. 27, 2001

Related U.S. Application Data

(60) Provisional application No. 60/211,667, filed on Jun. 15, 2000.

(51) Int. Cl.[7] ..... A47H 15/00
(52) U.S. Cl. ..... 16/105; 16/99
(58) Field of Search ..... 16/105, 99, 97, 16/87 R, 19, 32; 160/345, 346, 347; 49/420, 421, 425

(56) References Cited

U.S. PATENT DOCUMENTS 3,996,643 A * 12/1976 Steigerwald ..... 16/105
4,014,073 A * 3/1977 Uehara ..... 16/105
4,194,266 A * 3/1980 Natzel ..... 16/99
4,262,451 A * 4/1981 Dallaire ..... 16/105
4,633,615 A * 1/1987 Moose ..... 16/105
4,912,807 A * 4/1990 Futch ..... 16/90
5,950,279 A * 9/1999 Chaput ..... 16/105
6,021,547 A * 2/2000 Stagoll ..... 16/105

FOREIGN PATENT DOCUMENTS

JP 10-227170 * 8/1998

* cited by examiner

*Primary Examiner*—Chuck Y. Mah
(74) *Attorney, Agent, or Firm*—Lorusso & Loud

(57) ABSTRACT

The invention provides a wheel or roller assembly for a patio door or the like comprising a carriage having two parallel spaced side plates and a pair of grooved wheels mounted within the carriage that provide for the self adjustment of the roller wheels as while the wheels are adjusted. Also, while the roller wheels are being adjusted, the assembly provides an enhancement that will prevent the wheels from rocking out of level orientation in the full wheels up position.

12 Claims, 6 Drawing Sheets

ENHANCED PERFORMANCE TANDEM ROLLER FOR PATIO DOORS

CROSS-REFERENCE TO RELATED APPLICATIONS

A claim of benefit is made to provisional application No. 60/211,667 filed on Jun. 15, 2000, which is herein incorporated by reference.

BACKGROUND OF THE INVENTION (1) Field of the Invention

The present invention relates generally to roller wheel assemblies for patio doors, and more particularly to the improvements in the roller wheel assemblies for such doors that allow for increased over-all height adjustments and that provide for self leveling roller wheels in the wheel full up position. It will be appreciated, however, that the roller or wheel assembly could have many uses but it has been specifically designed for rolling or sliding patio doors.

(2) Description of the Prior Art

A vast assortment of roller assembly systems has been devised for sliding or patio doors. The present invention is concerned with one problem that is commonly encountered in connection with such doors. The problem referred to occurs when a wheel assembly might rock or fall out of level orientation. This invention addresses that problem by providing a self leveling roller wheel assembly that will not rock or fall out of level orientation while in the full up wheel position. The present invention also seeks to provide an increased over-all height (vertical) adjustment range by means of an adjustment to the assembly.

The closest prior art is a roller assembly used by Truth Hardware Corporation. It is from a consideration of an existing roller assembly that has lead to the development of the present invention. This existing roller, however, had problems. Thus, a need existed for a roller that would provide approximately 3/16th of an inch greater up/down adjustment and an anti-rocking feature in the wheels full-up position. Although there are numerous rollers available to mount sliding patio doors of various designs, none has the same structure as the present invention.

SUMMARY OF THE INVENTION

Accordingly, it is an object of the present invention to provide a roller assembly that provides for self-leveling as adjustments are made to position the roller assembly in the wheels full up position.

Another object of the present invention is to provide a roller assembly that will provide at least an increased over-all height adjustment by approximately 1/8 inch and up to 2 inches.

Another object of the present invention is to provide approximately 3/16 of an inch greater up/down adjustment to a potential of about 3 inches.

Still another object of the present invention is to provide a roller assembly with roller wheels that will not rock out of level orientation in the full up wheels position. This anti-rocking feature is to prevent the inner housing assembly wheels from leaving the level position that aids in the removal of the panel by preventing either wheel from rocking down to interfere with the track or other components of the sill.

Other objects and advantages of the present invention will become more obvious hereinafter in the specification and drawings.

In accordance with the present invention, an enhanced performance tandem roller assembly includes an outer housing assembly with two outer housing plates, an inner housing assembly consisting of two wheels, two inner housing plates and a wedge housing. A wedge is inserted into the wedge housing and the outer and inner assemblies are held together with an adjusting screw that has been threaded through the wedge and protrudes through the outer housing and a single washer. The end of the adjusting screw is swaged and all components are held in place. A single spacer can be added to the top of the roller to allow for the various height requirements as directed by the application.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein like reference numerals refer to like parts and wherein.

DESCRIPTION OF THE PREFERRED EMBODIMENT

Figure 1:
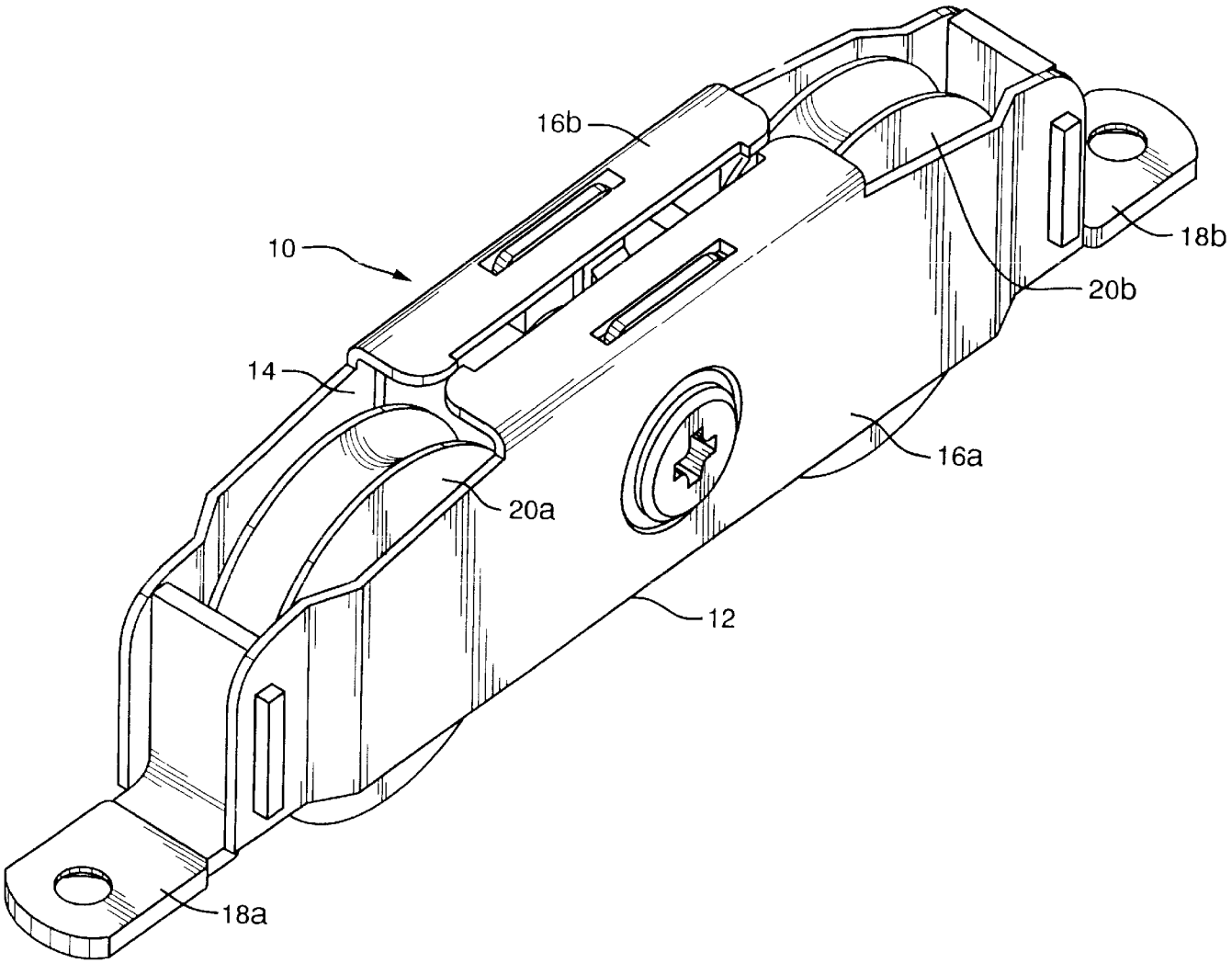
FIG. 1 is a perspective view of the tandem roller assembly in accordance with the present invention.
Figure 2:
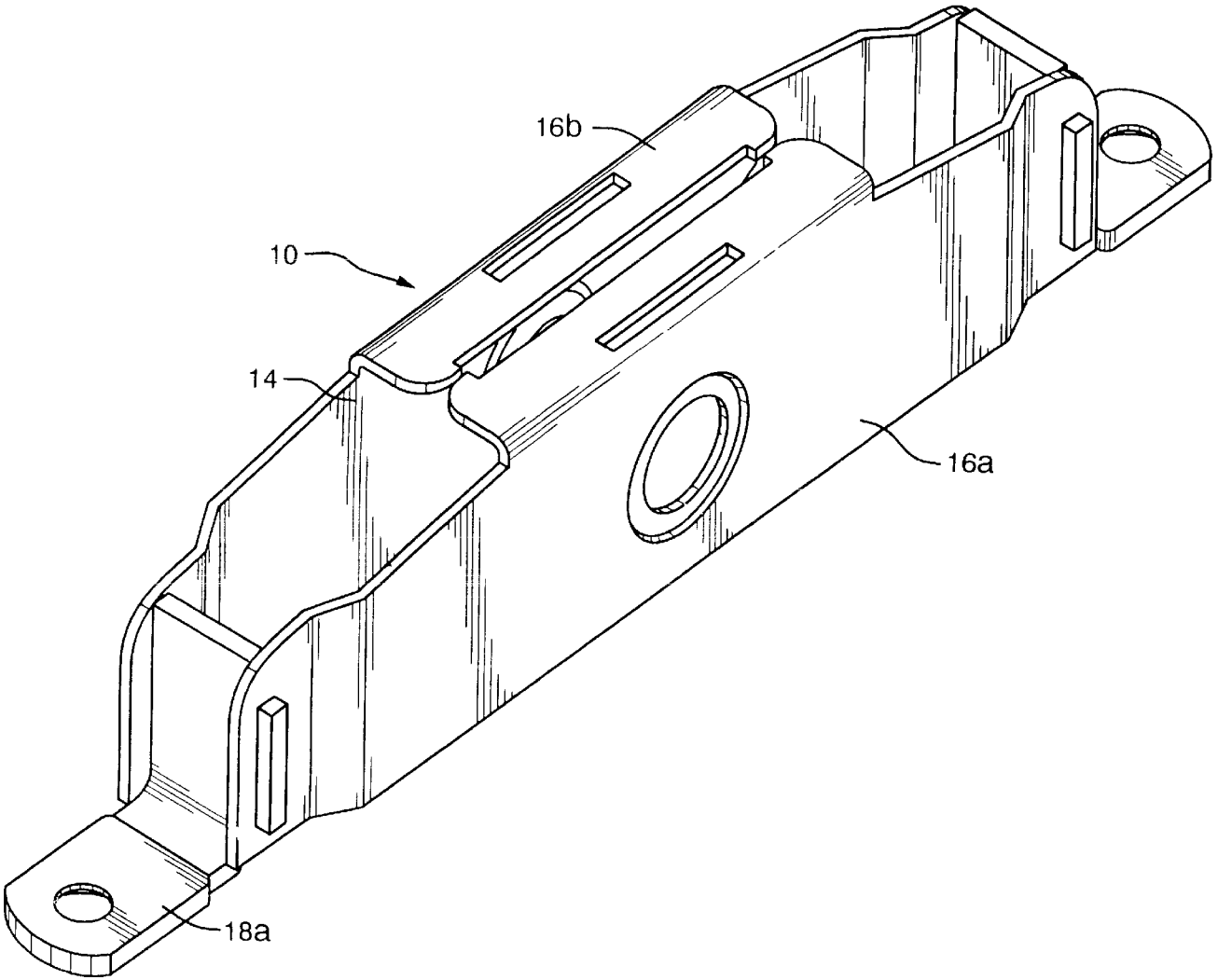
FIG. 2 is a perspective view of the outer housing assembly 12 as shown in FIG. 1.
Figure 3:
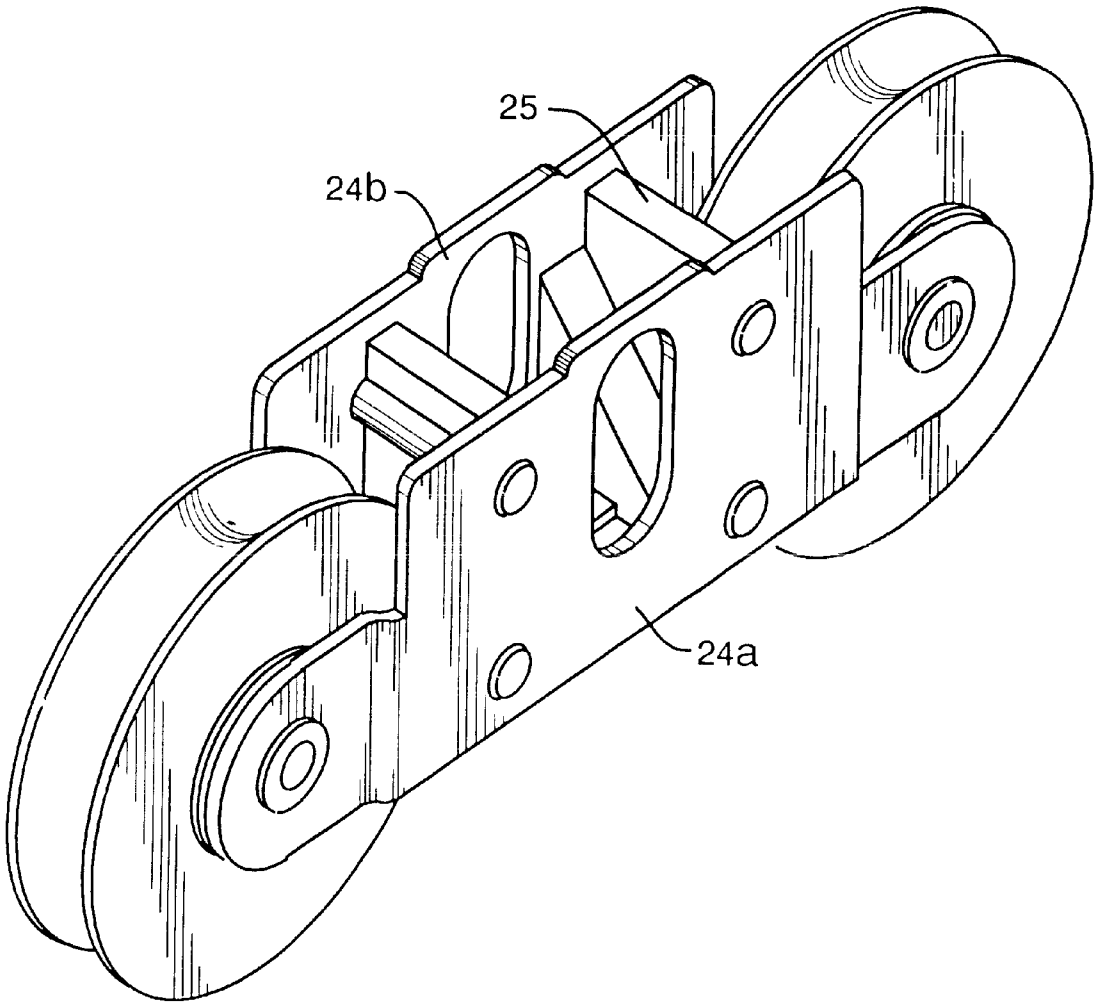
FIG. 3 is a perspective view of the inner housing assembly 14 as shown in FIG. 1.

Referring to FIGS. 1 through 6, an enhanced performance tandem roller assembly for guiding patio doors along a lower track according to a preferred embodiment of the present invention is shown. Turning first to FIG. 1, reference numeral 10 denotes an enhanced performance tandem roller assembly according to the invention. The roller assembly 10 consists of an outer housing assembly 12 and an inner housing assembly 14. Now referring to FIGS. 1–4, the outer housing assembly 12 consists of two outer housing plates 16*a*, 16*b* separated and held together by two mounting tabs 18*a*, 18*b* that can be of various styles and orientation depending on the (mounting) requirements. The mounting tabs 18*a*, 18*b* are located at opposite ends of the roller assembly. In the embodiment shown in FIGS. 1–6, the mounting tabs 18*a*, 18*b* are shown as corner angle brackets. Contained within this outer housing assembly 12, is an inner housing assembly 14, that consists of two grooved roller wheels 20*a*, 20*b*, two roller wheel rivet pins 22*a*, 22*b*, two inner housing plates 24*a*, 24*b* and a wedge housing 26. The two inner housing plates 24*a*, 24*b* are parallel to each other and retain the two roller wheels 20*a*, 20*b* in tandem between plates 24*a*, 24*b*. Roller wheels 20*a*, 20*b* are retained or secured in place by two roller wheel rivet pins 22*a*, 22*b*. The pair of roller wheels 20*a*, 20*b*, are received between the opposed, open parallel plates of the inner housing and are positioned at opposite ends of each other.

Figure 4:
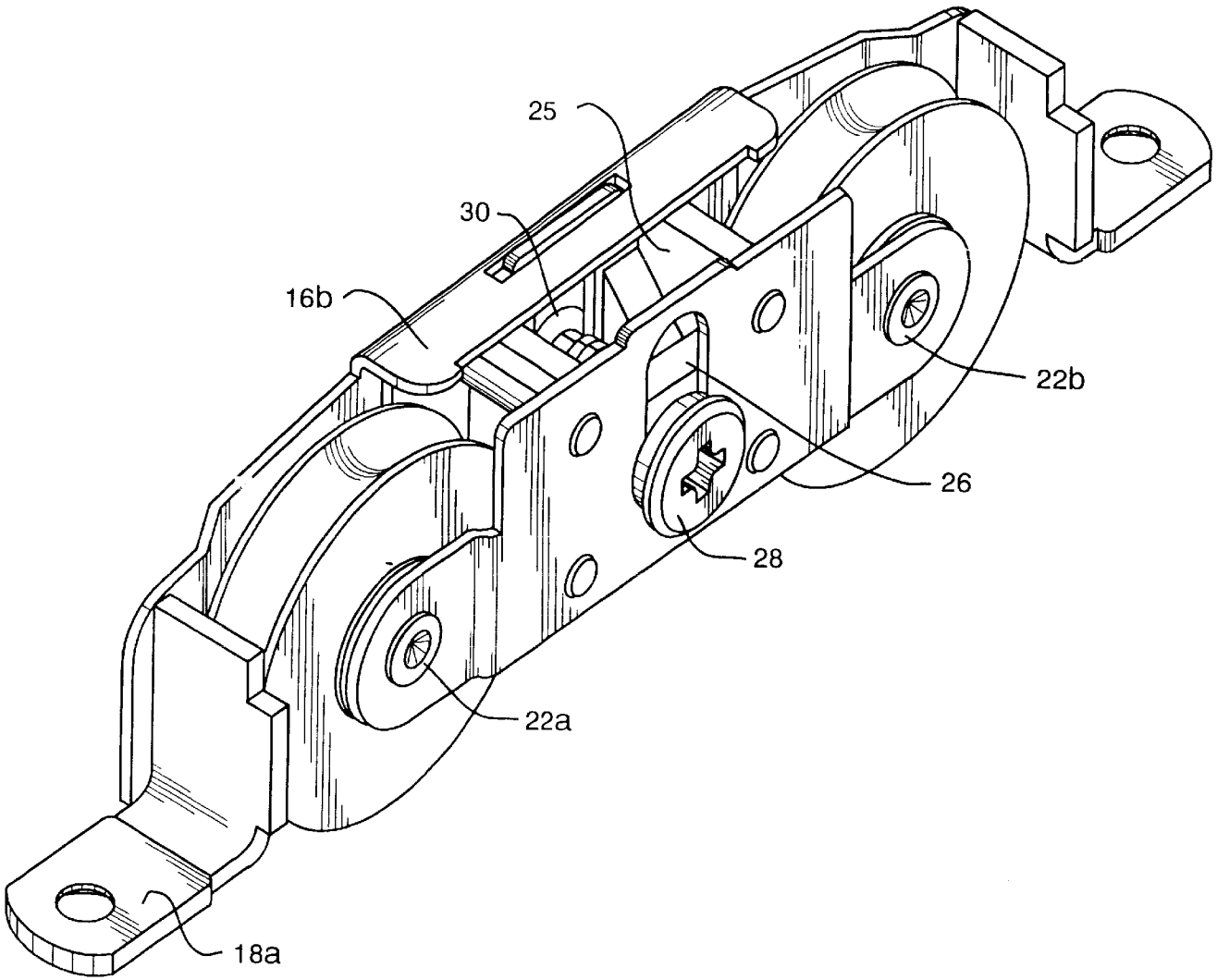
FIG. 4 is a perspective view of the tandem roller assembly of FIG. 1 with the one outer housing plate removed.
Figure 5:
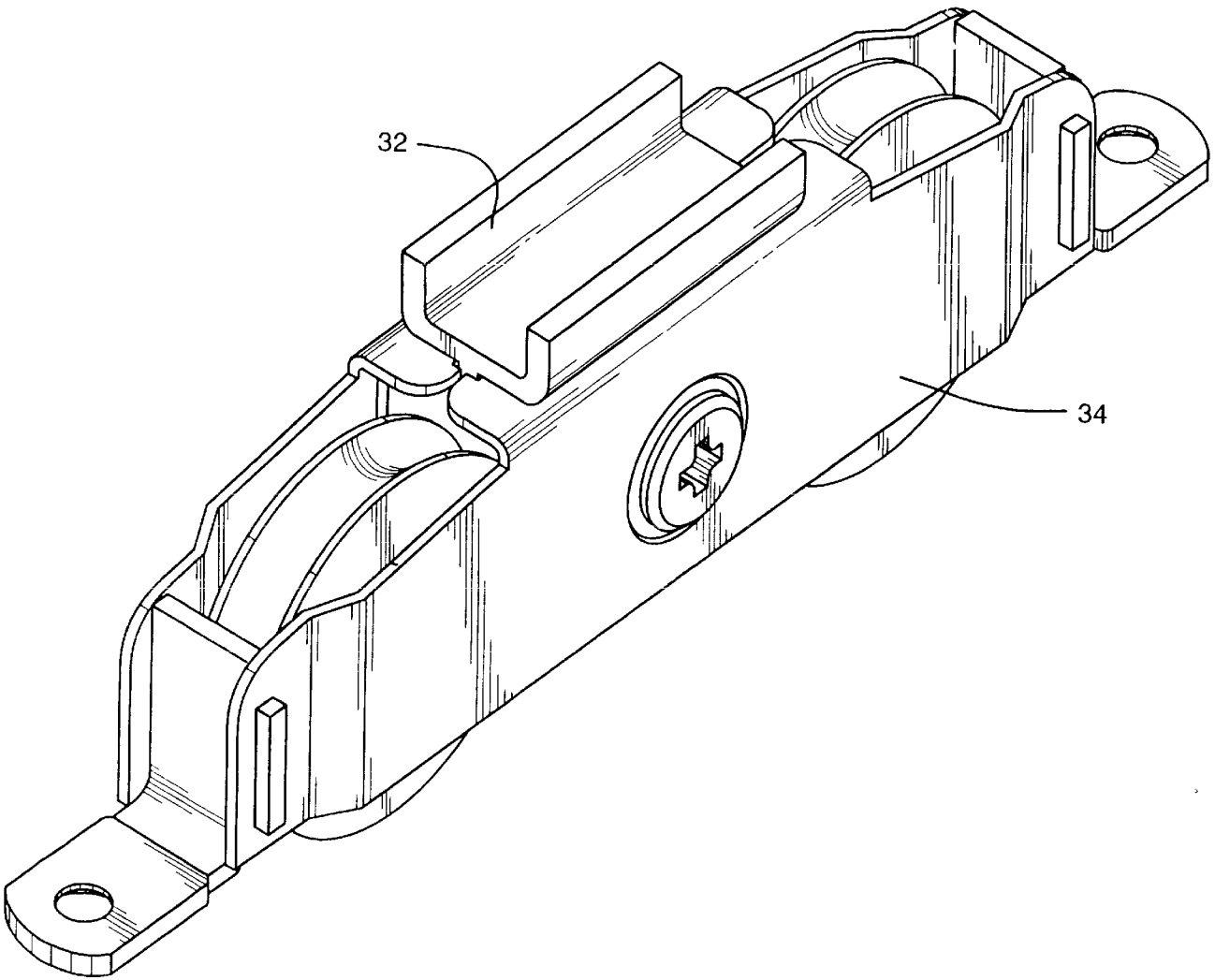
FIG. 5 is a perspective view of the tandem roller assembly of FIG. 1 with a spacer.

As can be seen in FIG. 4, one potential embodiment shows a wedge 26, parallel to inner housing plates 24*a*, 24*b*, is inserted into wedge housing 25. The outer housing 12 and the inner housing 14 assemblies are held together with an adjusting screw 28 that has been threaded through the wedge 26 and protrudes through one of the two outer housing plates 24*a* and then through a single washer 30. The wedge can also be in the form of an elliptical cam which when rotated would act upon the housings to adjust height. The screw would act to hold cam in a secure position and the height would be adjusted by the cams rotation. The washer 30 can be used to retain and provide a sliding or rotating surface with the outer housing 12. The end of the adjusting screw 28 can be swaged and all components are held in place. As is shown in FIG. 5, a single spacer 32 can be added to the top of the roller assembly 10 to allow for the various height requirements as directed by the application. The range is determined by the application but can be from about ⅛ inch to about 3 inches, but preferably ½ to ¾ of an inch.

Figure 6:
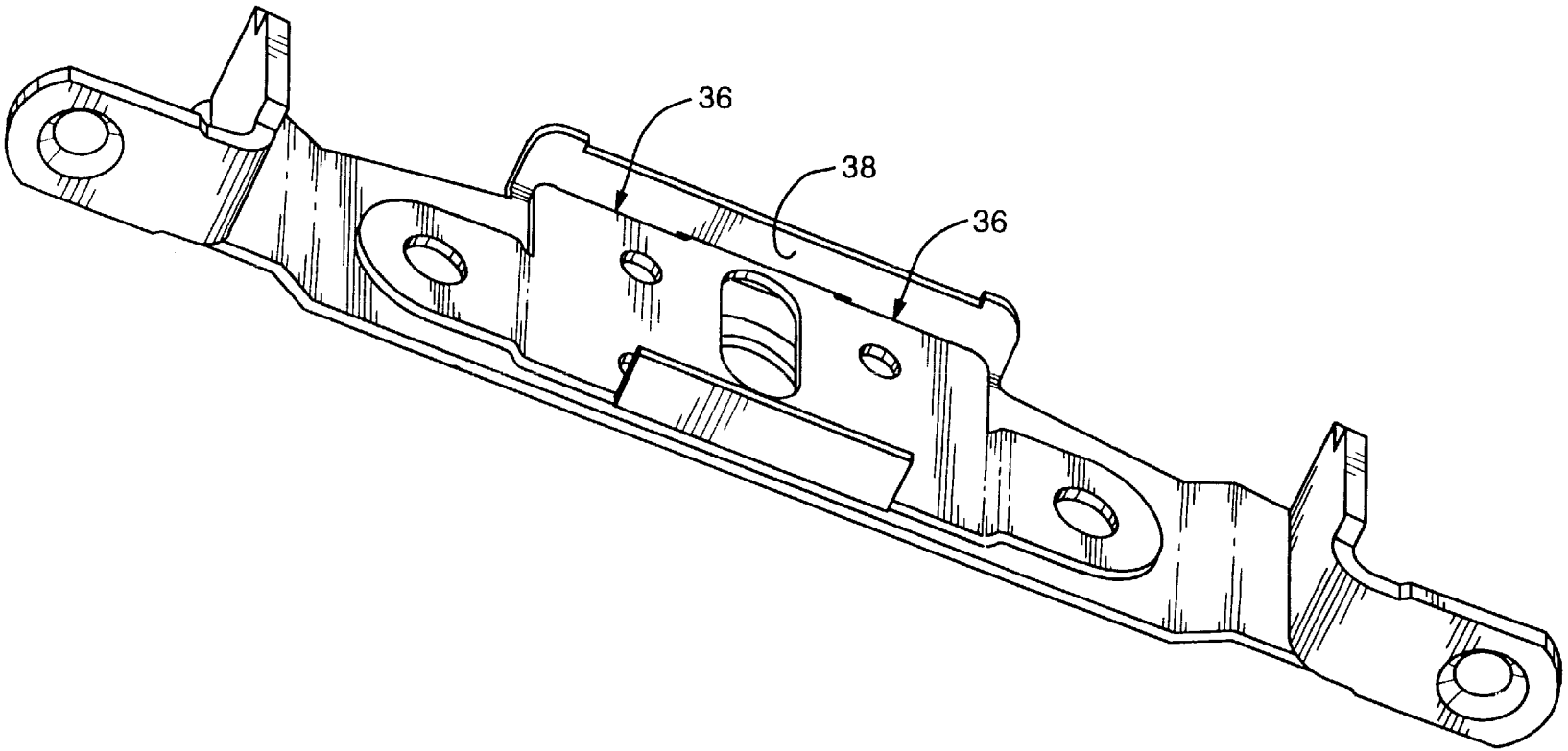
FIG. 6 is a perspective view of an anti-rock embodiment.

FIG. 6 shows one potential means for adjustably raising the height of the carrier member 34 by which the height of the door can be adjusted by increasing or decreasing the distance between the lowermost edge of member 34 and the support surface in which the housing sits. In the wheel full-up position, the upper edges 36 of the inner housing plate 24*a,* 24*b* come in contact with the inside underneath surface 38 of the outer housing 12. In this full-up position, the roller assembly wheels 20*a,* 20*b* are prevented from leaving the level position and therefore, rocking. When adjusting screw 28 is turned counter-clockwise, the weight of the door panel pushes the inner housing 14 up into the outer housing 12. This causes the edges 36 to come into contact with surface 38, the inner housing 14 is prevented from rocking. When the panel is lifted, the inner housing 14 stays in this position due to inherent friction "forces" built into the assembly 10. It will be appreciated therefore that when roller assembly 10 is in operation by having the operator turn or adjust screw 28, screw 28 forces or drives the wedge 26 which interacts with wedge housing 25 thereby raising or lowering inner housing 14.

The invention thus described is an enhanced performance tandem roller assembly that provides the ability to self-level the roller wheels as the wheels are adjusted into the full up position. The feature prevents the roller wheels from rocking out of level orientation in the full wheels up position.

Although the present invention has been described relative to a specific embodiment thereof, it is not so limited. The two mounting tabs can be of various styles and orientation depending on the (mounting) requirements. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An enhanced performance tandem roller assembly for patio doors, comprising:

an outer housing;

an inner housing;

at least two roller grooved wheels affixed to said inner housing to maintain said wheels in a fixed position relative to each other;

an adjustment mechanism which locks said inner housing to a desired height position within said outer housing;

wherein said outer housing is comprised of a pair of substantially parallel plates overlying said inner housing which limits travel of said inner housing to a vertical path while substantially limiting horizontal movement, and wherein said inner housing is comprised of a pair of parallel plates containing a slot therein which limits travel of said adjustment mechanism to a substantially vertical path, and an upper surface which is substantially parallel to the axis of said wheels wherein at the maximum height of said adjustment mechanism said upper surface abuts said outer housing wherein said abutment maintains the inner housing in a substantially level position relative to said outer housing;

at least one interlocking tab;

at least one interlocking edge wherein said interlocking tab and said interlocking edge are formed from an upper edge of said parallel plates of said inner housing;

at least one corresponding slot; and at least one locking edge wherein said outer housing's substantially parallel plates have at least one upper edge curved inward forming said locking edge and said corresponding slot is formed therein, wherein at the maximum height adjustment said interlocking tab is inserted into said corresponding slot, and said interlocking edge abuts said locking edge to maintain stability and leveling of said inner housing with respect to said outer housing.

2. The assembly of claim 1 wherein said adjustment mechanism comprises:

a wedge; and an angular surface having a higher end and a lower end wherein said position of said wedge upon said angular surface corresponds to said position of said inner housing within said outer housing.

3. The assembly of claim 2 wherein said adjustment mechanism further comprises:

a threaded shaft having a head designed for receiving a discontinuous rotational force; and a corresponding threaded bore within said wedge designed to accept said threaded shaft, wherein application of a discontinuous rotational force causes rotation of said threaded shaft and forces said wedge to ride against said angular surface causing a simultaneous horizontal and a corresponding vertical displacement of said wedge.

4. The assembly of claim 3 wherein said head has a head diameter, and wherein said outer housing has portions defining a corresponding hole having a diameter which is smaller than said head diameter and larger than the diameter of said threaded shaft.

5. The assembly of claim 4 wherein a washer is placed onto an opposing end of said threaded shaft, wherein said opposing end of said shaft is then swaged to keep said washer rotatably fixed, wherein said outer housing has portions defining a parallel corresponding hole having a diameter which is smaller than said washer diameter and larger than the diameter of said shaft, and wherein said shaft passes through both said parallel corresponding hole and said corresponding hole to stabilize the vertical movement of said inner housing within said outer housing.

6. The assembly of claim 5 wherein said head is swaged to secure the components around said shaft.

7. An enhanced performance tandem roller assembly for patio doors, comprising:

an outer housing;

an inner housing;

at least two roller grooved wheels affixed to said inner housing to maintain said wheels in a fixed position relative to each other;

an adjustment mechanism which locks said inner housing to a desired height position within said outer housing;

wherein said outer housing is comprised of a pair of substantially parallel plates overlying said inner housing which limits travel of said inner housing to a vertical path while substantially limiting horizontal movement, and wherein said inner housing is comprised of a pair of parallel plates containing a slot therein which limits travel of said adjustment mechanism to a substantially vertical path, and an upper surface which is substantially parallel to the axis of said wheels wherein at the maximum height of said adjustment mechanism said upper surface abuts said outer housing wherein said abutment maintains the inner housing in a substantially level position relative to said outer housing;

at least one interlocking tab;

at least one interlocking edge wherein said interlocking tab and said interlocking edge are formed from an upper edge of said parallel plates of said inner housing;

at least one corresponding slot; and at least one locking edge wherein said outer housing's substantially parallel plates have at least one upper edge curved inward forming said locking edge and said corresponding slot is formed therein, wherein at the maximum height adjustment said interlocking tab is inserted into said corresponding slot, and said interlocking edge abuts said locking edge to maintain stability and leveling of said inner housing with respect to said outer housing; and a single spacer affixed to said outer housing to allow for the various height requirements as directed by the application.

8. The assembly of claim 7 wherein said adjustment mechanism comprises:

a wedge; and an angular surface having a higher end and a lower end wherein said position of said wedge upon said angular surface corresponds to said position of said inner housing within said outer housing.

9. The assembly of claim 8 wherein said adjustment mechanism further comprises:

a threaded shaft having a head designed for receiving a discontinuous rotational force; and a corresponding threaded bore within said wedge designed to accept said threaded shaft, wherein application of a discontinuous rotational force causes rotation of said threaded shaft and forces said wedge to ride against said angular surface causing a simultaneous horizontal and a corresponding vertical displacement of said wedge.

10. The assembly of claim 9 wherein said head has a head diameter, and wherein said outer housing has portions defining a corresponding hole having a diameter which is smaller than said head diameter and larger than the diameter of said threaded shaft.

11. The assembly of claim 10 wherein a washer is placed onto an opposing end of said threaded shaft, wherein said opposing end of said shaft is then swaged to keep said washer rotatably fixed, wherein said outer housing has portions defining a parallel corresponding hole having a diameter which is smaller than said washer diameter and larger than the diameter of said shaft, and wherein said shaft passes through both said parallel corresponding hole and said corresponding hole to stabilize the vertical movement of said inner housing within said outer housing.

12. The assembly of claim 11 wherein said head is swaged to secure the components around said shaft.

* * * * *